US005307729A

United States Patent [19]

Hedlund

[11] Patent Number: 5,307,729

[45] Date of Patent: May 3, 1994

[54] DEVICE FOR STROKE END CUSHIONING AND SPEED REGULATING THE MOVEMENT OF A PISTON IN A FLUID PRESSURE CYLINDER

[75] Inventor: Staffan Hedlund, Bandhagen, Sweden

[73] Assignee: AB Rexroth Mecman, Stockholm, Sweden

[21] Appl. No.: 39,452

[22] PCT Filed: Oct. 30, 1991

[86] PCT No.: PCT/SE91/00733

§ 371 Date: Aug. 5, 1993

§ 102(e) Date: Aug. 5, 1993

[87] PCT Pub. No.: WO92/08899

PCT Pub. Date: May 29, 1992

[30] Foreign Application Priority Data

Nov. 9, 1990 [SE] Sweden ..... 9003578

[51] Int. Cl.[5] ..... F15B 15/22

[52] U.S. Cl. ..... 91/394; 91/406; 91/409

[58] Field of Search ..... 91/394, 405, 406, 407, 91/408, 409, 449, 468; 92/85 B

[56] References Cited

U.S. PATENT DOCUMENTS

| | | | |
|---|---|---|---|
| 3,122,063 | 2/1964 | Chorkey | 91/394 |
| 3,511,133 | 5/1970 | Day | 91/394 |
| 4,455,923 | 6/1984 | Muller | 91/407 |

*Primary Examiner*—Edward K. Look
*Assistant Examiner*—F. Daniel Lopez
*Attorney, Agent, or Firm*—Townsend & Townsend Khourie & Crew

[57] ABSTRACT

In a device for stroke end cushioning and speed regulating the movement of a piston (3) in a fluid pressure cylinder (1,2) a common adjusting means (9) is arranged for simultaneous setting of the throttle means (7,8) for regulating the stroke end cushioning as well as the piston speed, for the purpose of avoiding very time consuming adjustment. In connection with the setting of the adjusting means (9) the ratio between the flow areas of the respective throttle means is held within the range of 10–60%. In the most uncomplicated embodiment the common adjusting means (9) may be comprised by a screw being fixed to the valve bodies of the respective throttle means.

15 Claims, 3 Drawing Sheets

61
62
63
64
65
67
68

39
33
34

44
35
43

DEVICE FOR STROKE END CUSHIONING AND SPEED REGULATING THE MOVEMENT OF A PISTON IN A FLUID PRESSURE CYLINDER

The present invention concerns a device for stroke end cushioning and speed regulating the movement of a piston in a fluid pressure cylinder, comprising at least one pair of adjustable throttle means for throttling of the flow of fluid out from the cylinder, a first throttle means in said pair for regulating the piston speed being arranged to throttle the outflow of fluid through an outlet channel, a second throttle means in said pair for stroke end cushioning being arranged to throttle the outflow of fluid through a separate stroke end cushioning channel, and means for sealing the flow directly to the first throttle means from a cushioning chamber being formed in a certain mutual position between the cylinder end wall and the piston, forcing the outflow from said cushioning chamber to pass through the stroke end cushioning channel.

In fluid pressure cylinders and particularly cylinders for compressible fluid it is often necessary to have the possibility of controlling the piston speed. In such cylinders adjustment is normally achieved by a throttle which throttles the outflow of fluid from the outlet side of the cylinder. A cylinder with such a piston speed adjustment is previously known from GB,A,1 036 498.

Likewise it is often desired to slow down and cushion the movement of a piston and associated parts in the piston stroke ends. The reason for the desire to cushion the kinetic energy of these elements is the wish to avoid such stresses on the equipment that it would be exposed to otherwise without cushioning. A completely uncushioned piston is capable of striking onto the cylinder end wall with great mass energy forces as a result, while all the kinetic energy is cushioned by the throttling in an ideal cushioning process, so that the velocity of the piston falls down to zero when the piston reaches the cylinder end wall.

For the understanding of the complexity of the cushioning process it is pointed out that it depends on several parameters such as kinetic energy, cushioning length, motive power, friction, dead volume, i.e. the remaining volume when the piston reaches the end wall (such as cavities around sealing strips, channels etc). etc. To achieve an acceptable cushioning these parameters must be balanced to each other.

Stroke end cushioned cylinders are previously known in a number of variations, e.g. the applicants own marketed cylinder (the 170 series), which comprises a so called cushion sleeve cooperating with a recess in the piston at the stroke ends, forcing the outflowing fluid to pass a particular throttle U.S. Pat. No. 2,935,047 shows a stroke end cushioned cylinder wherein cushion sleeves on the piston cooperate with sealing strips to force the fluid flowing out to pass a throttle at the stroke end. U.S. Pat. No. 4,393,751 shows a hydraulic cylinder with stroke end cushioning, wherein two axially spaced ports in the cylinder wall lead directly to the outlet and via a throttle to the outlet respectively.

Through WO,A1,88/03609 a cylinder is further known being provided with an adjusting screw 6*a* for piston speed regulation and a particularly adjusting screw 13 for setting of a suitable cushioning. The provition of two separate means (adjustings screws) for setting the piston speed and the cushioning respectively, brings about, however, very time consuming setting and adjusting work if a desired speed and at the same time acceptable cushioning is to be achieved, since the setting of one of the two parameters, cushioning and piston speed, also affects the other.

It is therefore an object of the present invention to provide a practically useful equipment for the simple setting of speed and cushioning in a fluid pressure cylinder. This object is achieved with a device comprising the features as set forth in the characterizing part of claim 1.

A further object is to provide an equipment of the kind mentioned above which is simple in setting also by a not specially trained operator.

It has thus been found that if the two throttle means are adjusted simultaneously by the same adjusting element and the ratio between the two areas of the respective throttle means is held within the range of 10–60%, particularly 15–40% (c.f. claim 2), a well suited piston speed regulation and at the same time an acceptable cushioning is achieved.

The ratio between the flow areas may be held substantially constant during the adjustment, as is stated in claim 3, or vary within said range. Further the ratio may be adjusted in advance, as is stated in claim 4, e.g. for adjustment to various working conditions. Where the ratio between the flow areas should be held within the range depends on the desire of the user and may be tested out in advance. Cylinders with the desired characteristics, including throttle ratio being adjusted in advance, may then be produced and delivered.

The adjusting element with the associated throttle means may be elaborated in a number of different ways. The claims 5–13 set forth different features characterizing different embodiments of adjusting means and throttle means. Common to those is that they are simple and costworthy in production. The embodiments according to the claims 10–13 are particularly costworthy.

By the adjusting means with the associated throttle means being placed either in the cylinder end wall or in a separate unit, as said forth in claim 14, the equipment may be adapted to different types of cylinders.

In a strict sense, a device of the kind so far described only "regulates" the cushioning to a certain extent. If the cushioning length is fixed however, it is not fully feasible to adjust the cushioning characteristic to different kinetic energy levels. To achieve ideal cushioning, it is of course possible to modify the cylinder in such a way that the cushioning length may be adjusted.

In a further embodiment according to claim 15 it is however possible to achieve full control of the cushioning process at different loads—with or without adjustable cushioning length. This is achieved by providing the cylinder with a chamber of adjustable volume which communicates with the cushioning chamber of the cylinder, whereby the cushioning may be fully adjusted to the kinetic energy to be cushioned.

The invention will know be described in greater detail with reference to the appended drawings.

Figure 1:
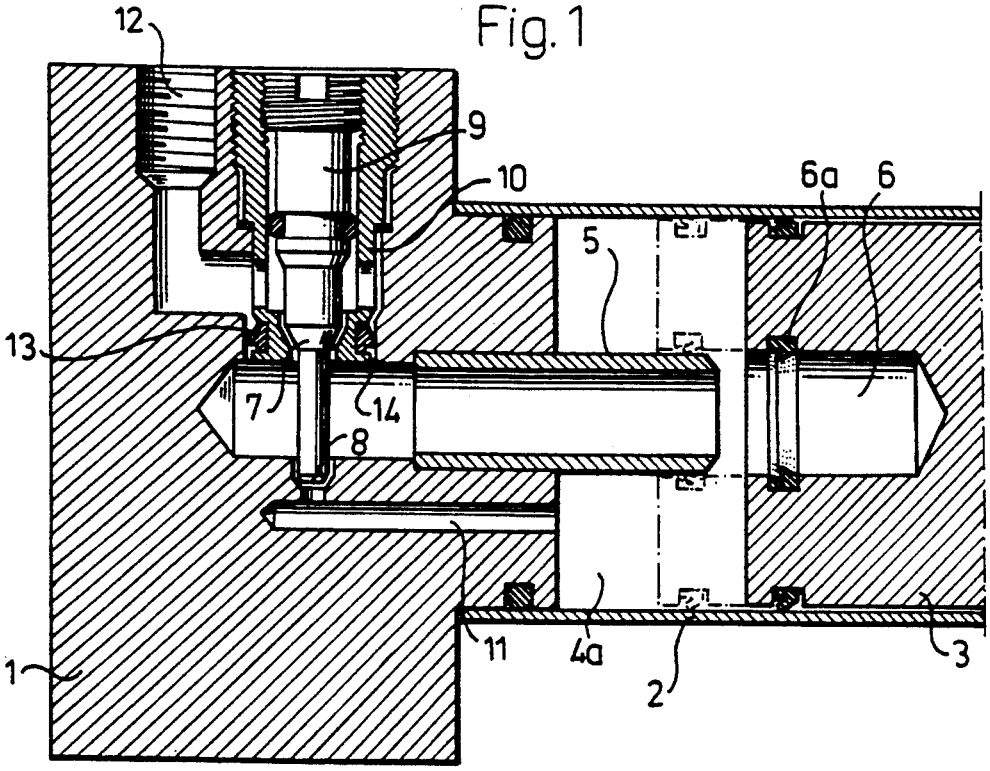
FIG. 1 shows a section through a part of a cylinder according to the invention.
Figure 3:
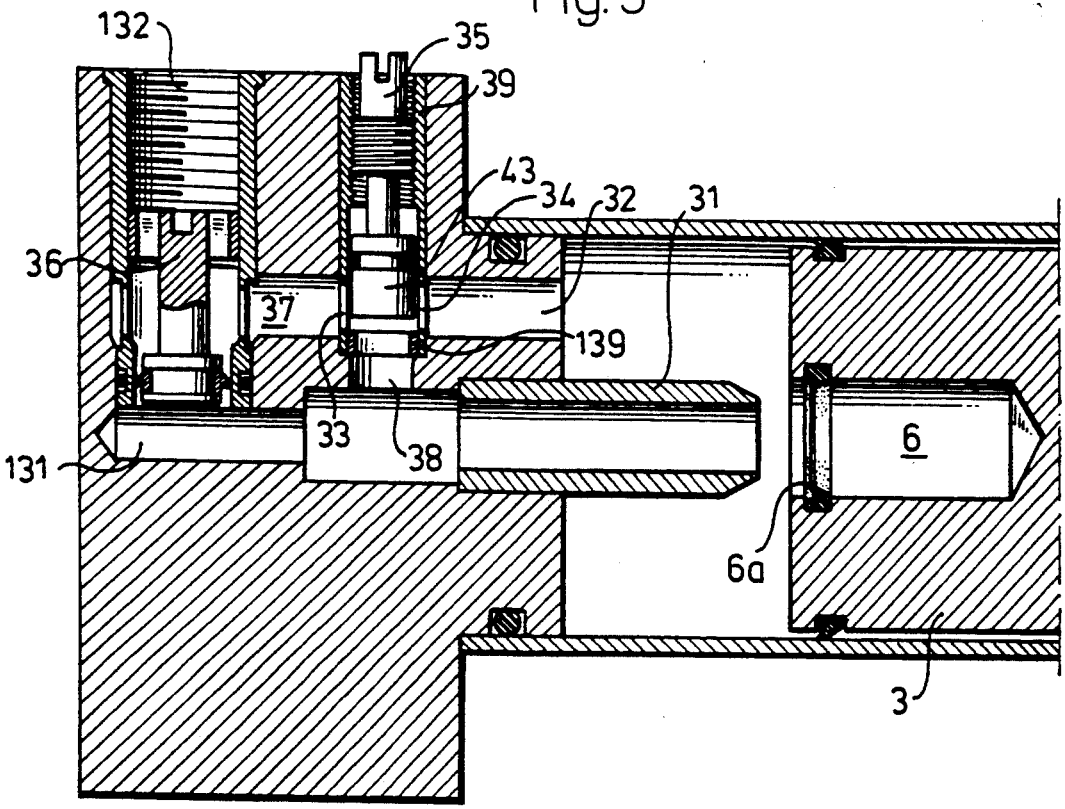
FIG. 3 shows a further embodiment of the invention with an other type of adjusting means.
Figure 5:
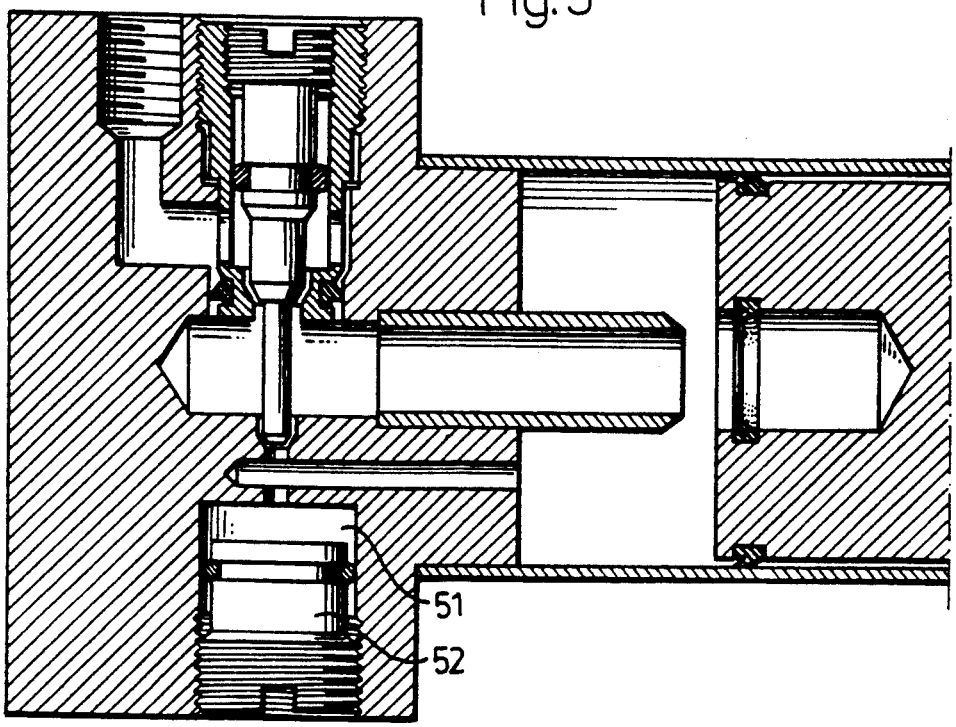
Figures 4A, 4B, 6:
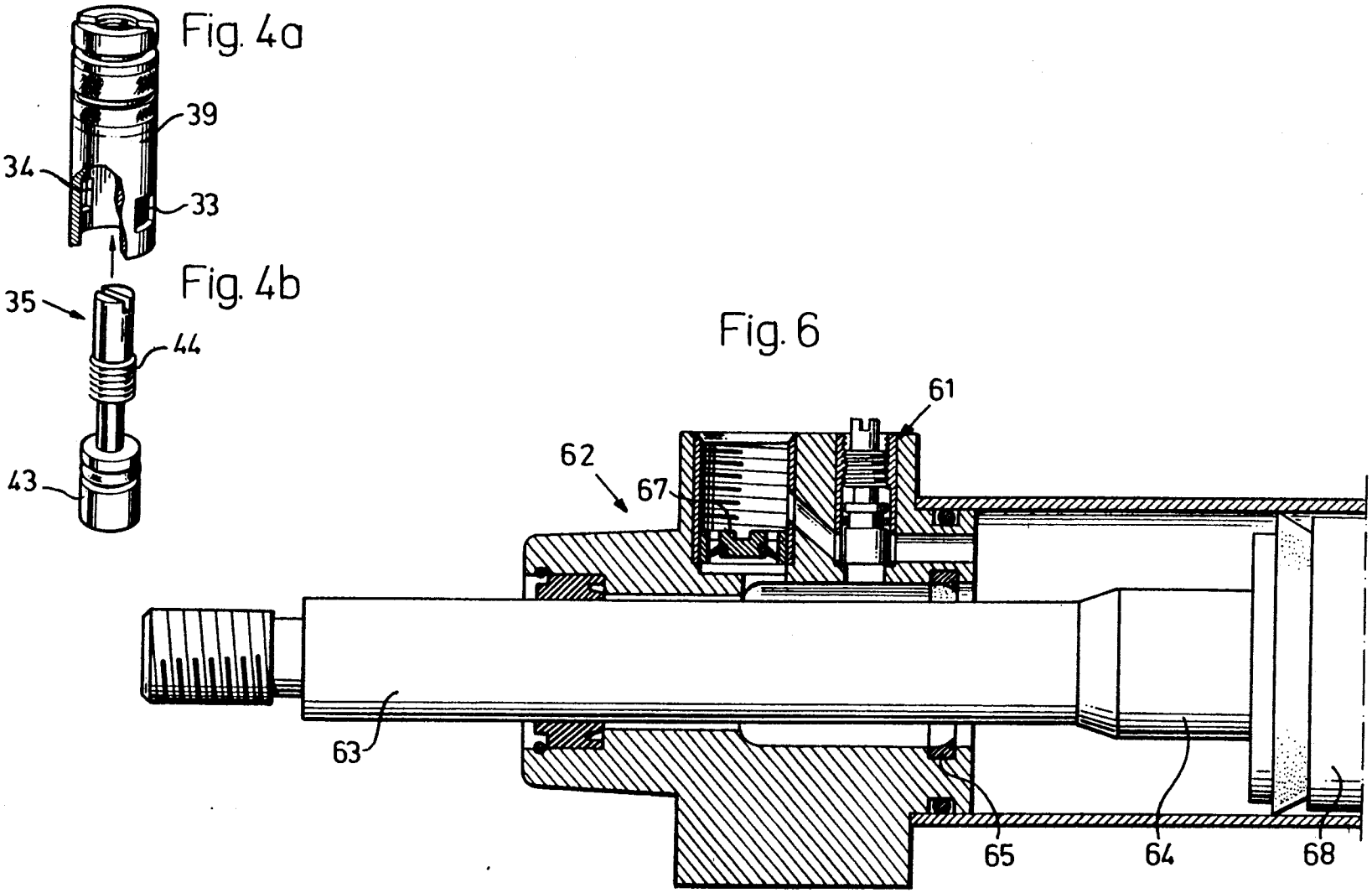

FIG. 4*a* and 4*b* show the adjusting means and the throttling means according to FIG. 3 in an exploded view;

FIG. 5 shows a device according to FIG. 1 with an adjustable dead volume chamber; and FIG. 6 shows a device according to the invention in a cylinder end wall with a through piston rod.

FIG. 1 thus shows a cylinder with a cylinder end wall 1 and a cylinder tube 2, wherein a piston 3 is axially movable. The piston 3 divides the cylinder into a first chamber 4*a* and a second chamber (not shown). The cylinder end wall is provided with a cushion sleeve 5, extending into first chamber 4*a*. The piston 3 is provided with a recess 6 having a seal 6*a* for the cooperation with the cushion sleeve. When the piston is in the shown position and moves to the left in the figure, the exhaust working fluid will pass through the inside of the cushion sleeve 5, pass through a first throttle means 7 and thereafter leave the cylinder end wall through an outlet channel 12, (which also serves as inlet channel when the piston is moving in the opposite direction, i.e. to the right in FIG. 1). The first throttle means 7 provides the possibility of adjusting the piston speed when the piston is moving to the left in FIG. 1. When the piston has reached the position indicated by dashed lines in FIG. 1, the so called cushioning chamber is formed, whereafter the cushion sleeve 5 and the seal 6*a* of the recess 6 starts to cooperate. In this position the outflowing fluid deriving from the first chamber 4*a* may not pass through the cushion sleeve 5 but is forced into a stroke end cushioning channel 11 for the subsequent passing of a second throttle means 8, the first throttle means 7 and thereafter leave the cylinder end wall through the outlet channel 12. The throttle valve bodies of the throttle means are fixed to one another and to a common adjusting means 9. By setting the common adjusting means 9, which is comprised by a screw with a recess for a screwdriver, the throttle valve bodies may be brought closer to or further away from the respective throttle valve seat.

From FIG. 1 it is further apparent that the adjusting means 9 is seated in a sleeve 10, which is properly fixed in the material of the cylinder end wall 1. The sleeve 10 forms an annular slot 14 in connection with the in-/outlet channel 12. A lip seal 13 with non return valve function is seated in said annular slot 14. The lip seal 13 provides almost free passage of pressure fluid in the direction into the cylinder but stops the passage of fluid leaving the cylinder whereby the exhaust fluid is forced to pass the first throttle means 7.

Figure 2:
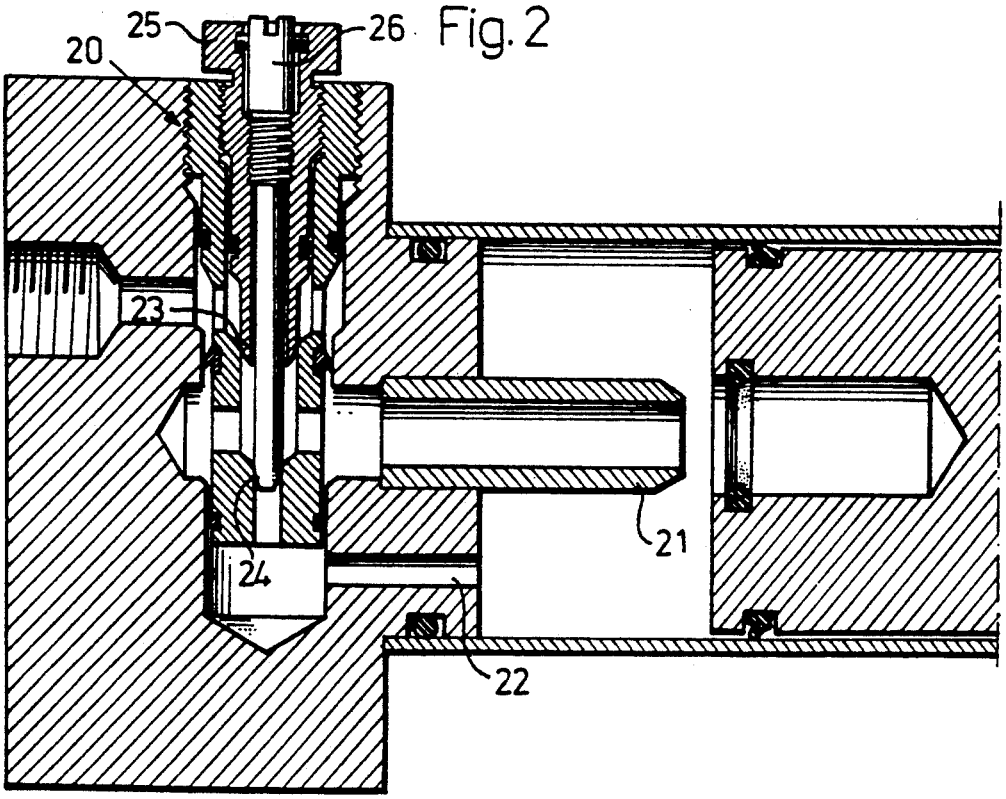
FIG. 2 shows an embodiment of the invention where the ratio between the two throttle areas is adjustable.

FIG. 2 shows a further embodiment of the invention with a modified, common adjusting means for two throttle means 23, 24 being arranged in connection with a cushion sleeve 21 and a stroke end cushioning channel 22. The adjusting means, in this case generally indicated with 20, here comprises a first screw 25 for the adjusting of the first throttle means 23. A second screw 26 is screwed into the first screw 25 and constitutes the valve body of the second throttle means 24 at its lower portion. This embodiment provides the possibility of separate adjustment of the second throttle means by the second screw 26 and common adjustment of both of the two throttle means by the first screw 25.

FIG. 3 shows still another embodiment of the common adjusting means with associated throttle means in connection with a cushion sleeve 31, a stroke end cushioning channel 32 and an outlet channel 37. A transverse sleeve 39 is arranged between the stroke end cushioning channel 32 and the outlet channel 37 said sleeve 39 in the inside being provided with a cylindrical valve body 43 (c.f. FIG. 4*a* and 4*b*) and an adjusting means 35. The adjusting means 35 provides axial displacement of the cylindrical valve body 43, which on the one hand cooperates with a throttle opening 34 in the stroke end cushioning channel 32, and on the other hand with a throttle opening 33 in the outlet channel 37, thus forming the second and the first throttle means respectively. Inside of the adjacent in-/outlet channel 132 there is arranged a non return valve device 36, being provided with a lip seal with non return function, which is seated in an annular slot, being formed between a cylindrical body and a surrounding sleeve. This annular slot thus serves as the main inlet for working fluid when this side of the cylinder comprises the pressure side. The fluid passing the annular slot and flows into the cylinder through the channel 131 and the cushion sleeve 31 and presses the piston 3 to the right. A retaining ring 139 is mounted in the lower part of the sleeve 39. This retaining ring limits the axial downward movement of the adjusting means and may also provide a reference for the adjustment.

FIGS. 4*a*, 4*b* show in an exploded perspective view the sleeve 39 and the valve body 43 with its adjusting means 35 according to FIG. 3. The adjusting means comprises a thread 44 which cooperates with a corresponding thread of the sleeve. By turning the adjusting means, the cylindrical valve body 43 will be displaced axially and thereby in cooperation with the throttle openings 33, 34 regulate the throttling action of the two throttle means. By the throttle openings 33, 34 having essentially rectangular shape, as is evident from FIG. 4 it is achieved that the throttling action of the two throttling means may be altered linearly when controlling the adjusting means.

When the piston 3 has reached the position shown in FIG. 3 and moves to the left in the figure, the outflowing working fluid will pass in the inside of the cushion sleeve 31 and flow into a channel 38, which leads to the first and the second throttling means. The working medium will then pass the throttle opening 33 of the first throttling means and thereafter leave the cylinder end wall via the outlet channel 37.

When the piston reaches the position where the cushioning chamber is formed and the recess 6 with the seal 6*a* of the piston 3 cooperates with the cushion sleeve 31, the outflowing fluid is prevented from flowing through the cushion sleeve 31 (except for the volume inside of the recess 6), and will be forced into the stroke end cushioning channel 32 for the passage of the throttle opening 34 of the second throttle means, whereafter it will pass the throttle opening 33 of the first throttle means and subsequently leave the cylinder end plate via the outlet channel 37.

FIG. 5 shows a further development of the invention, and 52 indicates a means for regulating the volume of the chamber 51, which communicates with the cylinder. Since the chamber 51 is provided with an adjustable volume, the total volume to be compressed in connection with stroke end cushioning may be adjusted. The chamber 51 does not have to be arranged in the cylinder end plate, but may be contained in a separate unit outside of the cylinder.

In the embodiment according to FIG. 6 the adjusting means 61 with the associated throttle means is mounted in a cylinder end plate 62 with through piston rod 63. In this case the piston 68 is provided with a cushion sleeve or nose 64 for the cooperation with a seal 65. The arrangement of the adjusting means 61 and the non return valve 67 is in this case of course adapted to a space at the side of the piston rod.

The invention is not limited to the embodiments described above, but only to the scope of the claims. The throttle means may e.g. be connected to the adjusting means via means for transmitting a movement without being fixed to the adjusting means. The transmitting means may be comprised of links, gears, belts as gear belts, screws or other suitable means.

The throttle means may also comprise non rotation symmetrical, axially moveable valve bodies. The valve bodies may e.g. have a square section.

Further the throttle openings of the throttle means may be shaped to provide a desired characteristic with respect to the present working conditions. Thus, the throttle openings of FIG. 4*a* may be shaped in another way, e.g. essentially triangular, either pointing towards or away from the adjusting means. The throttle means may also be shaped as tap valves.

The non return valve may of course also be designed according to any other suitable previously known construction.

Finally, the adjustable chamber communicating with the cylinder room, provides an essential feature to achieve further technical effect in connection with the invention, but it may also be used in other applications such as cushioning control in pneumatic cylinders without piston speed regulation. The chamber may be shaped in a number of different ways with the function maintained. It may e.g. be comprised of a piston-cylinder unit being contained in the cylinder end plate or in a separate unit being connected to the cylinder. The position of the piston of the adjustable volume chamber may thereby be set with an optional suitable control means.

I claim:

1. Device for stroke end cushioning and speed regulating the movement of a piston (3) in a fluid pressure cylinder (1,2), comprising at least one pair of adjustable throttle means (7,8;23.24;33,34) for throttling of the flow of fluid out from the cylinder, a first throttle means (7;23;33) in said pair for regulating the piston speed being arranged to throttle the outflow of flow through an outlet channel (12;37), a second throttle means (8;24;34) in said pair for stroke end cushioning being arranged to throttle the outflow of fluid through a separate stroke end cushioning channel (11;22;32), and means (5,6a;21;31;64,65) for sealing the flow directly to the first throttle means from a cushioning chamber, being formed in a certain mutual position between the cylinder end wall and the piston, forcing the outflow from said cushioning chamber to pass through the stroke end cushioning channel, characterized in that both of the throttle means in said pair are jointly adjustable by one adjusting means (9;25,26;35) in such a way that the ratio between the flow areas of the second and the first throttle means is held within the range of 10–60%.

2. Device according to claim 1, characterized in that said range is 15–40%.

3. Device according to claim 1, characterized in that said ratio is held essentially constant during the setting of the throttle means.

4. Device according to claim 1, characterized in that said ratio is adjustable in advance within said range.

5. Device according to claim 1, characterized in that the adjusting means comprises a (first) screw (9;25;35) which will affect the throttling action of both of the throttle means when turned.

6. Device according to claim 5, characterized in that the screw (9) is provided with two essentially conical, axially spaced throttle valve bodies for the cooperation with a respective throttle valve seat.

7. Device according to claim 6, characterized in that the axial distance between the throttle valve bodies is adjustable.

8. Device according to claim 7, characterized in that the valve body associated with the one throttle means is fixed to a second screw (26), which is screwed axially within the first screw (25) and thereby axially displaceable with respect to this.

9. Device according to claim 1, characterized in that there is a sleeve (10) within which at least the first throttle means is arranged, said sleeve being surrounded by an annual shunting slot (14), within which a seal (13) with non return valve function is mounted, allowing the main pressure fluid flowing into the cylinder to pass through said annular slot outside of the first throttle means (7), while the fluid outflow is forced to pass through said first throttle means.

10. Device according to claim 1, characterized in that the adjusting means (35) is connected to at least one cylindrical valve body (43) being rotatable inside of a cylindrical chamber (within 39) and cooperating with first and second throttle openings (33,34) in the envelope surface of this chamber for the forming of the first and the second throttle means.

11. Device according to claim 10, characterized in that the cylindrical valve body (bodies) (43) furthermore is axially displaceable.

12. Device according to claim 1, characterized in that said adjusting means being connected to a cylindrical valve body (43) which is axially displaceable within a cylindrical chamber (within 39) and which cooperates with first and second openings (33,34) in the envelope surface of said chamber for the forming of the first and the second throttle means.

13. Device according to claim 10, characterized in that said throttle openings (33,34) are essentially rectangular, so that the throttle action of the two throttle means may be altered linearly when controlling the adjusting means (35).

14. Device according to claim 1, characterized in that said adjusting means and the associated two throttle means are placed either within said cylinder end wall or in a separate unit being connected to the cylinder.

15. Device according to claim 1, wherein the pressure fluid is compressible, characterized in that there is a chamber (51) communicating with the cylinder, said chamber (51) being provided with adjustable volume for the variation of the total volume being compressed in connection with stroke end cushioning, for the purpose of adjusting the cushioning process to the kinetic energy to be cushioned.

* * * * *